US006937109B2

(12) United States Patent
Tanbakuchi et al.

(10) Patent No.: US 6,937,109 B2
(45) Date of Patent: Aug. 30, 2005

(54) BALANCED MICROWAVE CONNECTOR AND TRANSITION USING A COAXIAL STRUCTURE

(75) Inventors: Hassan Tanbakuchi, Santa Rosa, CA (US); Paul E. Cassanego, Santa Rosa, CA (US); Kenneth H. Wong, Santa Rosa, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 185 days.

(21) Appl. No.: 10/309,543

(22) Filed: Dec. 4, 2002

(65) Prior Publication Data

US 2004/0108914 A1 Jun. 10, 2004

(51) Int. Cl.[7] ..... H01P 1/04; H01P 3/04

(52) U.S. Cl. ..... 333/4; 333/260; 174/21 C; 174/27

(58) Field of Search ..... 333/1, 4, 5, 260, 333/182; 174/21 C, 27, 88 C, 88 S; 439/607, 620

(56) References Cited

U.S. PATENT DOCUMENTS 3,551,858 A * 12/1970 Cielo ..... 333/182
4,215,326 A * 7/1980 Hollyday ..... 333/182
4,296,390 A * 10/1981 Vanderheyden et al. .... 333/182

OTHER PUBLICATIONS

Radiall, S.A., Leaflet entitled "The Multi–Port Connectors" (2002).

Amphenol Corporation Catalog, "Twinaxial", pps. 123–25 (2002).

* cited by examiner

*Primary Examiner*—Benny Lee

(57) ABSTRACT

A connector interface provides high-frequency differential connection to a balanced cable or balanced electronic device, such as a balanced probe. The connector interface includes two coaxial structures in a single connector. When the connector interface is used in a package launch, the closeness of the center pins of the two coaxial structures facilitate connection to a balanced circuit. When used in conjunction with a balanced vector network analyzer, the connector interface can simplify calibration and testing of devices by reducing the number of connections to the calibration standards or devices being tested, and provide improved measurement accuracy.

20 Claims, 3 Drawing Sheets

BALANCED MICROWAVE CONNECTOR AND TRANSITION USING A COAXIAL STRUCTURE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to high-frequency components and more particularly to a connector interface having dual-coaxial microwave structures.

BACKGROUND OF THE INVENTION

High-frequency connectors are used in cable ends, package feedthroughs, adaptors, probes, and similar applications. Connector interfaces typically provide a single coaxial structure that maintains the characteristic impedance of the transmission line through the connector. Balanced techniques, which use two high-frequency transmission lines, are desirable in some applications because they can provide a larger signal and superior noise immunity compared to unbalanced techniques, but generally involve making twice as many connections to a device or circuit.

Balanced cables are presently available with two coaxial cables that are joined within a single cable housing for most of the length of the cable, but these balanced cables are basically two coaxial cables with regular coaxial cable ends. Joining the cables together for most of their length avoids some inter-cable movement and keeps the cables reasonably balanced, but connecting the cables to a device requires connecting each of the cable ends causing relative movement between the cable ends that can introduce measurement error or uncertainty. Other presently available types of balanced cables extend center conductors of two coaxial transmission lines through a single connector without maintaining the coaxial structures of the transmission lines through the connector. While these types of balanced cables are typically used at low frequencies (e.g. below 200 MHz), they are not well suited for use in high-frequency applications.

BRIEF SUMMARY OF THE INVENTION

A high-frequency connector interface constructed according to the embodiments of the present invention includes two coaxial structures within a single connector barrel. The coaxial structures are essentially parallel to each other and extend away from a face of the connector interface. An alignment feature, such as an alignment pin and corresponding hole, polarizes the connector interface and keeps the connector interface from twisting when connection is made to a mating part. In one embodiment, a connector interface is incorporated in a package launch, enabling close spacing of the feedthrough pins. In another embodiment, a connector interface is provided at the end of a balanced cable. In yet another embodiment, a connector interface is provided in an adaptor that connects two conventional coaxial cables to the connector interface.

DETAILED DESCRIPTION OF THE INVENTION

I. Introduction

A connector interface constructed according to the embodiments of the present invention includes two coaxial structures within a single connector provides superior balanced high-frequency performance and allows closer pin spacing compared to conventional coaxial connectors. Balanced high-frequency techniques are used in a variety of applications, such as digital communication analysis, digital oscilloscopes, wafer testing, differential vector network analysis, or to run separate signals side-by-side, such as a test signal with a clock signal or a test signal with a reference signal. Conventional balanced measurement techniques use a pair of connectors. If conventional connectors are used to connect coaxial transmission lines to an electronic circuit, such as a printed wiring board ("PWB"), differential probe, integrated circuit, or thick- or thin-film hybrid microcircuit, the connectors are spaced far apart, to allow for connecting and disconnecting each connector. It is difficult to achieve high-frequency balanced circuits with the spacing resulting from paired conventional connectors.

II. Exemplary Connectors

Figure 1A:
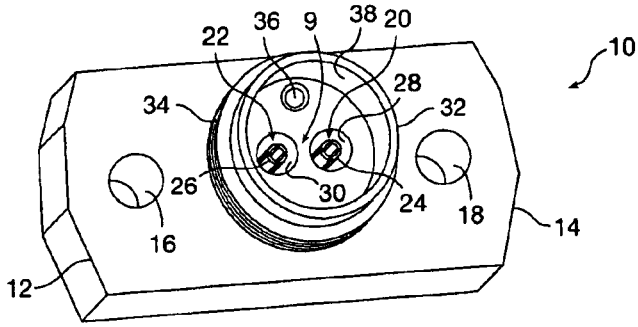
FIG. 1A is a simplified perspective view of a connector interface according to an embodiment of the present invention incorporated in a package launch.

FIG. 1A is a simplified perspective view of a connector interface 9 according to an embodiment of the present invention incorporated in a package launch 10. The package launch includes mounting flanges 12, 14 with thru holes 16, 18 for attaching the package launch to a package of an electronic device. Two coaxial structures 20, 22 are incorporated into the connector interface. The coaxial structures typically correspond to a connector standard, such as 1.0 mm, 1.85 mm, 2.4 mm, SMA, or other connector standard. Alternatively, the coaxial structures are not in accordance with any connector standard. It is not necessary that each coaxial structure within a connector interface have the same dimensions. In one example, each coaxial structure conforms to a 1.85 mm connector standard, with center pins 24, 26 supported within the conductive outer walls 28, 30 of the coaxial structures. The center pins are male-female type, but alternatively are overlapping or butt-contact center pins, which are known as sexless connectors.

The 1.85 mm connector standard provides high-frequency performance up to 70 GHz. The center pins have compliant fingers to accept a mating center conductor (see FIG. 1B, ref. nums. 46, 48). Connectors with center pins that accept center conductors, such as the differential package launch interface illustrated in FIG. 1A, are typically referred to as "female" connectors, and the corresponding connectors with protruding center conductors or pins are referred to as "male" connectors.

A barrel 32 includes threads 34 for securing a nut captivated on the mating part (see FIG. 1C, ref. num. 76) configured to screw onto the threads. In one alternative, the nut is on the barrel and the mating connector part is threaded. In another alternative, a bayonet-type, snap-on, or other mechanical coupling technique is used. An alignment feature 36 polarizes the connector interface and aligns the center conductors of the mating parts, as well as prevents twisting of one part relative to the other when the nut is tightened. The alignment feature is a countersunk hole that is configured to accept an alignment pin (see FIG. 1B, ref. num. 54), which is typically rounded or chamfered to facilitate insertion into the hole. In a particular embodiment, each half of a connector interface pair includes a pin and an alignment hole corresponding to the alignment hole and pin on the mating part. In another embodiment, one half of a connector interface pair has two pins, and the mating part has two alignment holes. The pins and holes may be offset or of different diameter to further prevent misalignment. Polarization of the connector interface insures that the correct coaxial structures are coupled to their respective transmission lines on the mating part. Other alignment features, such as a key and slot outside the barrel of the connector interface are alternatively used.

It is generally desirable that the alignment pin contacts the alignment feature before the center pins contact the center conductors. The mating part also has a rim that contacts the inner diameter 38 of the connector interface. The rim works in conjunction with the alignment pin to guide the center conductors into the center pins without twisting the center conductors with respect to the center pins. Twisting might deform the center conductors and/or center pins, and might even break fingers off of the center pins. Even if the center conductors and center pins are not permanently bent, misalignment or twisting of the connectors can degrade measurement accuracy. The center pins and center conductors of conventional connectors having radial symmetry are typically not deformed or broken by mere twisting between the mating connector parts.

Figure 1B:
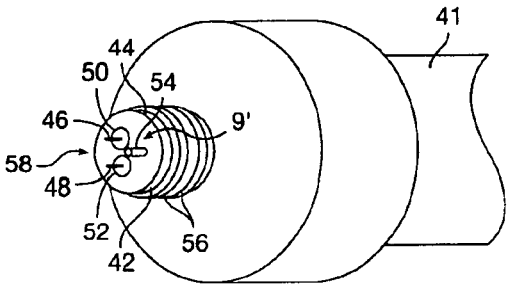
FIG. 1B is a simplified perspective view of a connector interface according to another embodiment of the present invention incorporated in the end of a balanced cable.

FIG. 1B is a simplified perspective view of a connector interface 9' according to another embodiment of the present invention incorporated in the end of a balanced cable 41. This connector interface 9' is configured to mate with the connector interface 9 illustrated in FIG. 1A. The barrel 42 of the connector interface includes a rim 44 that is partially inserted into the inner diameter (see FIG. 1A, ref. num. 38) before the center conductors 46, 48 of the coaxial transmission lines 50, 52 contact the center pins of the connector interface on the package launch. A pin 54 is also partially inserted into the alignment feature (see FIG. 1A, ref. num. 36) before the center conductors contact the center pins. A nut (not shown in FIG. 1B for clarity of illustration) is retained by ridges 56 on the connector end, allowing the nut to spin as it is tightened onto the threads of the package launch to secure the face 58 of the connector interface on the balanced cable against the opposing face of the connector interface on the package launch.

Figure 1D:
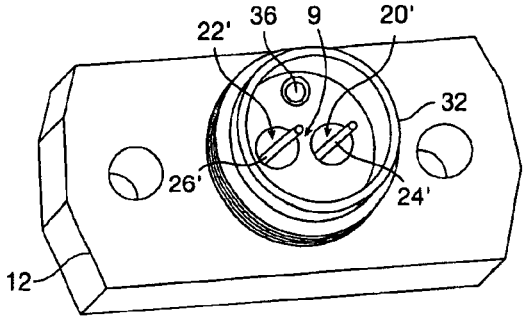
FIG. 1D is a simplified perspective view of a connector interface according to another embodiment of the present invention incorporated in a package launch.
Figure 1C:
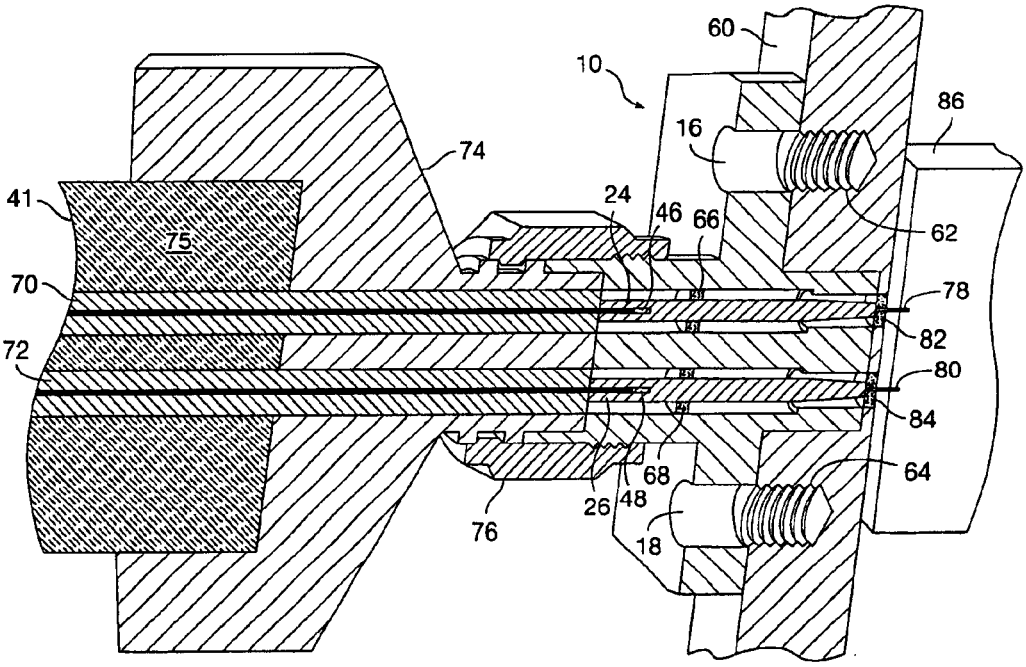
FIG. 1C shows a cross section of the connector interface of FIG. 1A connected to the connector interface of FIG. 1B.

FIG. 1C shows a cross section of the connector interface of FIG. 1A connected to the connector interface of FIG. 1B. The package launch 10 is shown mounted on a circuit package 60. The screws that would typically be inserted through the mounting holes 16, 18 of the package launch and screwed into the screw holes 62, 64 of the circuit package are omitted for clarity of illustration.

The center pins 24, 26 of the connector interface of the package launch 10 are supported with dielectric stand-offs 66, 68 inside the coaxial structures and accept the center conductors 46, 48 of the two coaxial cables 70, 72 in the balanced cable 41. A cable end 74 is machined from metal and securely holds the ends of the coaxial cables. The coaxial cables may be semi-rigid coaxial cables that include center conductors separated from outer conductors by dielectric spacers. The balanced cable is filled with compliant polymer 75 to support the coaxial cables and generally maintain their relationship to each other as the balanced cable is bent. A nut 76 on the cable end 74 engages the threads on the package launch 10 to securely connect the mating connector interfaces. Alternatively, the nut is provided on the package launch and the cable end is threaded. Similarly, the package launch is alternatively a male connector, and the cable end is a female connector.

Feedthrough pins 78, 80 extend from the opposite (distal) end of the package launch through glass feedthroughs 82, 84 into the interior of the circuit package 60. The feedthrough pins may then be electrically connected to an electronic circuit 86. The feedthrough pins include a glass-to-metal seal, which seals the circuit package. Alternatively, the feedthrough pins extend into the package without a glass-to-metal seal.

FIG. 1D is a simplified perspective view of a connector interface 9 according to another embodiment of the present invention incorporated in a package launch. A first coaxial structure 20' includes a male center conductor 24' and a second coaxial structure 22' includes a second male center conductor 26'. The connector interface 9 also includes the mounting flange 12, barrel 32 and alignment feature 36, as described above in reference to FIG. 1.

III. Balanced VNA Measurements and Adaptors

Figure 2A:
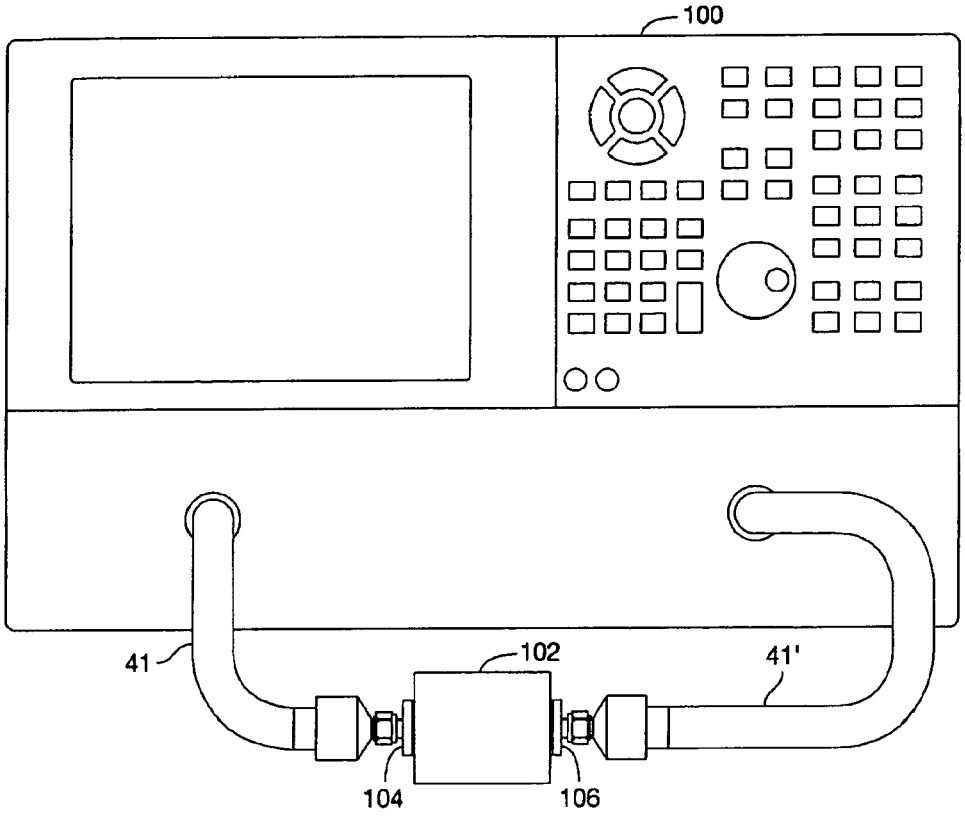
FIG. 2A shows an electronic device with connector interfaces according to the present invention coupled to a vector network analyzer with balanced cables.

FIG. 2A shows an electronic device 102, commonly referred to as a device under test ("DUT"), with connector interfaces 104, 106 according to the present invention coupled to a vector network analyzer ("VNA") 100 with balanced cables 41, 41'. Each balanced cable contains two coaxial transmission lines and has a cable end with a connector interface according to the present invention that is connected to the corresponding connector interface of the electronic device.

Figure 2B:
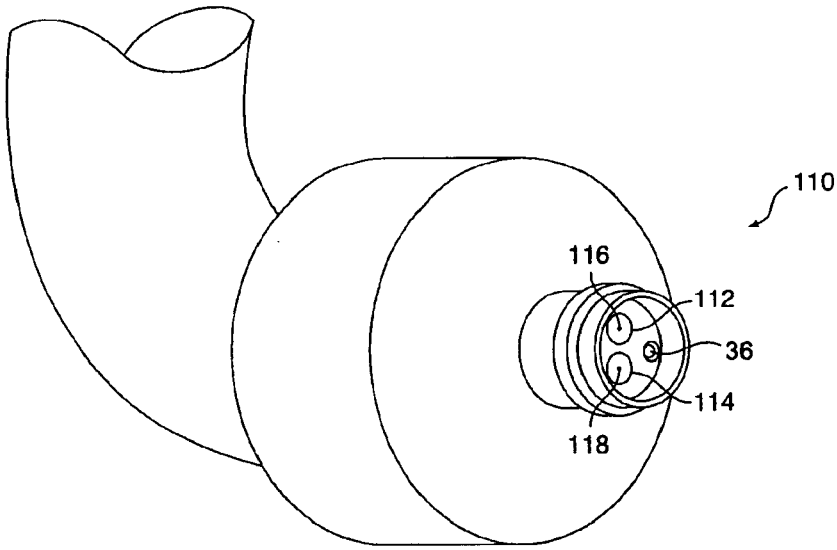
FIG. 2B is a simplified perspective view of a connector interface incorporated in the end of a balanced cable according to an alternative embodiment of the present invention.

FIG. 2B is a simplified perspective view of a connector interface 110 incorporated in the end of a balanced cable according to an alternative embodiment of the present invention. The balanced cable is similar to the balanced cable illustrated in FIG. 1B; however, the connector interface is a female connector interface, similar to the female connector interface illustrated in FIG. 1A, rather than the male connector interface illustrated in FIG. 1B. The connector interface has two coaxial structures 112, 114 with center pins 116, 118 that accept center conductors of the mating connector part. An alignment feature 36 keeps the connector interface from twisting when connecting or disconnecting the mating part.

Figure 3:
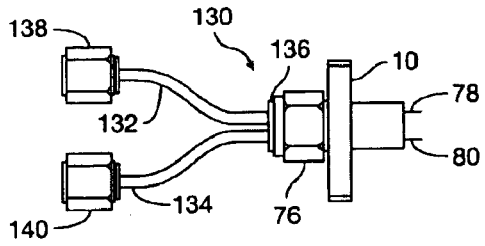
FIG. 3 shows a connector interface according to an embodiment of the present invention incorporated into an adaptor assembly connected to a package launch.

FIG. 3 shows an adaptor assembly 130 with a connector interface 136 according to an embodiment of the present invention connected to a package launch 10. The adaptor assembly joins two coaxial cables 132, 134, such as semi-rigid coaxial cable, into the connector interface 136. A nut 76 on the package launch engages threads on the connector interface 136 of the adapter assembly 130. The opposite ends of the coaxial cables have conventional connector ends 138, 140, such as 1.85 mm or 2.4 mm cable ends.

The package launch provides differential feedthrough pins 78, 80 that are about 3 mm apart. Providing differential feedthrough pins in such close proximity facilitates electrical connection to PCBs, microcircuits, or integrated circuits ("ICs") and enables measurement of common-mode and differential-mode signals. The connector interfaces on the adaptor and the mating connector interface on the package launch are referred to as "differential connectors" for purposes of discussion. In a particular embodiment, a differential connector is used with a wafer probe to provide accurate, high-frequency measurements of unpackaged ICs. It is desirable that the feedthrough pins are not more than 5 mm apart (center-to-center) to facilitate the transition from the connector interface to a balanced device or circuit. In particular, it is desirable to avoid having to change the spacing between balanced transmission lines on a circuit to accommodate pin spacing. Balanced transmission lines are usually parallel, and introducing an angle between the balanced transmission lines can cause unwanted radiation patterns. Balanced transmission lines on circuits packaged using conventional side-by-side coaxial connectors usually diverge near the package wall to accommodate the wider pin spacing (typically about 11 mm), which alters the characteristics of the balanced transmission lines.

Package launches according to embodiments of the present invention can provide pins 2 mm apart, and in another embodiment, 3 mm apart. A pin spacing of about 3 mm (±10%) is particularly desirable for connecting to balanced high-frequency circuits and devices because it allows connecting the pins to parallel, balanced transmission lines, thus maintaining superior transmission characteristics at high frequencies. Alternatively, a 5 mm spacing or a 7 mm pin spacing is provided by other embodiments of the present invention.

The adaptor assembly 130 can be used to connect a balanced test cable to an electronic device with conventional differential package launches, to connect an electronic device having a package launch with a connector interface according to an embodiment of the present invention to a conventional VNA, or to use a balanced test cable to perform a two-port measurement (or a four-port measurement with two balanced test cables and two adaptors), for example. The part of a connector pair with the nut is typically the male part; however, adaptor assemblies are alternatively male-male, male-female, female-male, or female-female, and the differential connector interface 136 of the adaptor assembly 130 is alternatively threaded.

Figure 4:
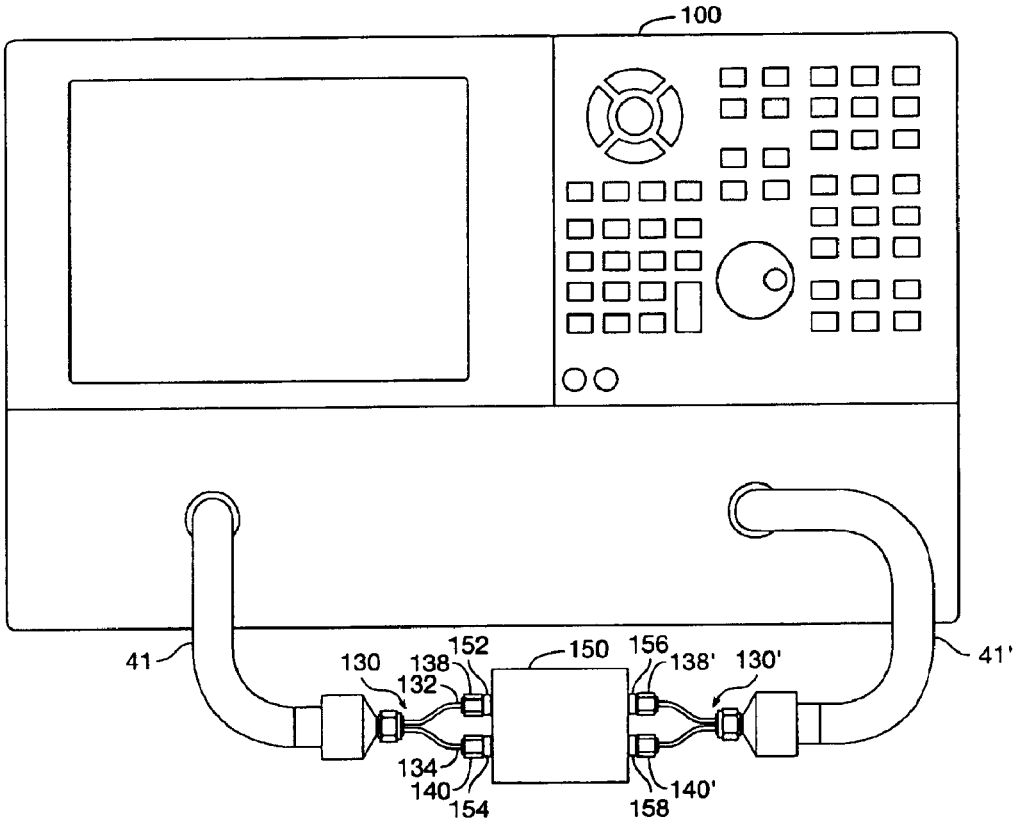
FIG. 4 shows adaptor assemblies illustrated in FIG. 3 connecting an electronic device having conventional package feedthroughs to a balanced vector network analyzer.

FIG. 4 shows adaptor assemblies 130, 130' illustrated in FIG. 3 connecting an electronic device 150 having conventional package feedthroughs 152, 154, 156, 158 to a balanced VNA 100. The adaptor assembly 130 separates the two coaxial transmission paths from a balanced cable 41 into two coaxial transmission lines 132, 134. These separated coaxial transmission lines are connected to conventional coaxial package feedthroughs 152, 154 with conventional coaxial cable ends 138, 140 of the adaptor assembly 130. Another adaptor assembly 130' similarly connects conventional coaxial package feedthroughs 156, 158 with conventional coaxial cable ends 138', 140' to a second balanced cable 41'. This configuration may be used to perform balanced two-port measurements on a conventional differential two-port electronic device, or to perform four-port measurements on a four-port electronic device, using a balanced VNA and balanced cables.

A balanced cable with a cable end incorporating a connector interface constructed according to an embodiment of the present invention provides desirable advantages over conventional cables used with VNA systems because of the stability of the balanced cable. Most of the transmission line length between the VNA 100 and the electronic device 150 is a balanced test cable 41, which maintains balance through the connector interface and is less likely to introduce measurement error due to movement of the test cables, compared to conventional four-cable systems or balanced cables with conventional cable ends.

While the preferred embodiments of the present invention have been illustrated in detail, it should be apparent that modifications and adaptations to these embodiments may occur to one skilled in the art without departing from the scope of the present invention as set forth in the following claims.

What is claimed is:

1. A connector interface comprising:

a face;

a barrel circumscribing the face;

a first coaxial structure extending from the face;

a second coaxial structure extending from the face and being essentially parallel to the first coaxial structure, both the first coaxial structure and the second coaxial structure being disposed within the barrel; and an alignment feature formed in at least one of the face and the barrel.

2. The connector interface of claim 1 wherein the first coaxial structure conforms to a 1.85 mm connector standard.

3. The connector interface of claim 1 wherein each of the first coaxial structure and the second coaxial structure conform to a 1.85 mm connector standard.

4. The connector interface of claim 1 wherein the first coaxial structure includes a female center pin.

5. The connector interface of claim 4 wherein the second coaxial structure includes a second female center pin.

6. The connector interface of claim 1 wherein the first coaxial structure includes a male center conductor.

7. The connector interface of claim 6 wherein the second coaxial structure includes a second male center conductor.

8. The connector interface of claim 1 wherein the first coaxial structure includes a sexless center conductor.

9. The connector interface of claim 1 wherein the alignment feature comprises a hole configured to accept an alignment pin.

10. The connector interface of claim 1 further comprising a first feedthrough pin extending from a first distal end of the first coaxial structure relative to the face and a second feedthrough pin extending from a second distal end of the second coaxial structure relative to the face, the first feedthrough pin being not more than 5 mm from the second feedthrough pin.

11. The connector interface of claim 10 wherein the first feedthrough pin is 3 mm from the second feedthrough pin.

12. The connector interface of claim 1 further comprising:

a first coaxial transmission line extending from the first coaxial structure; and a second coaxial transmission line extending from the second coaxial structure.

13. The connector interface of claim 12 wherein the first coaxial transmission line and the second coaxial transmission line are incorporated in a balanced cable.

14. The connector interface of claim 13 wherein the balanced cable includes compliant material between the first coaxial transmission line and the second coaxial transmission line.

15. The connector interface of claim 12 wherein the first coaxial transmission line ends in a first coaxial connector and the second coaxial transmission line ends in a second coaxial connector.

16. A connector interface comprising:

a face;

a first coaxial structure including a first center pin extending from the face; and a second coaxial structure essentially parallel to the first coaxial structure, the second coaxial structure including a second center pin extending from the face, the first center pin being separated from the second center pin by not more than 5 mm when measured center-to-center.

17. The connector interface of claim 16 wherein each of the first coaxial structure and the second coaxial structure conform to a 1.85 mm connector standard.

18. A connector interface comprising:

a differential connector having a face, a barrel circumscribing the face, a first coaxial structure extending from the face, and a second coaxial structure extending from the face and being essentially parallel to the first coaxial structure, the first coaxial structure and the second coaxial structure being disposed within the barrel;

a first coaxial transmission line coupled to the first coaxial structure and ending in a first coaxial connector end; and a second coaxial transmission line coupled to the second coaxial structure and ending in a second coaxial connector end.

19. The connector interface of claim 18 wherein the first coaxial transmission line and the second coaxial transmission line comprise semi-rigid coaxial cable.

20. The connector interface of claim 18 wherein the first coaxial connector end is a first male coaxial connector end, the second coaxial connector end is a second male coaxial connector end, and the differential connector is a female connector.

* * * * *